US011319905B2

(12) United States Patent
Yang et al.

(10) Patent No.: US 11,319,905 B2
(45) Date of Patent: May 3, 2022

(54) EGR COOLER AND ENGINE SYSTEM HAVING THE SAME

(71) Applicants: Hyundai Motor Company, Seoul (KR); Kia Motors Corporation, Seoul (KR)

(72) Inventors: Il Suk Yang, Gyeonggi-do (KR); Dong Young Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 128 days.

(21) Appl. No.: 16/437,549

(22) Filed: Jun. 11, 2019

(65) Prior Publication Data

US 2020/0263639 A1 Aug. 20, 2020

(30) Foreign Application Priority Data

Feb. 20, 2019 (KR) ..... 10-2019-0019757

(51) Int. Cl.

| | |
|---|---|
| ***F02M 26/29*** | (2016.01) |
| ***F02M 26/32*** | (2016.01) |
| ***F01P 3/20*** | (2006.01) |
| ***F02M 26/12*** | (2016.01) |
| ***F02M 26/30*** | (2016.01) |

(52) U.S. Cl.

CPC ..... *F02M 26/29* (2016.02); *F01P 3/20* (2013.01); *F02M 26/12* (2016.02); *F02M 26/30* (2016.02); *F02M 26/32* (2016.02); *F01P 2060/00* (2013.01)

(58) Field of Classification Search

CPC .... F02M 26/22–33; F01P 3/20; F28D 7/0066; F28D 7/1661

USPC ..... 123/568.12; 165/164–176

See application file for complete search history.

(56) References Cited

U.S. PATENT DOCUMENTS

| | | | | |
|---|---|---|---|---|
| 2008/0164014 | A1* | 7/2008 | Nakamura | F02M 26/32 165/165 |
| 2008/0236792 | A1* | 10/2008 | Mast | F02M 26/32 165/157 |
| 2008/0251242 | A1* | 10/2008 | Irmler | F02M 26/32 165/164 |
| 2010/0025024 | A1* | 2/2010 | Meshenky | F28F 3/025 165/164 |
| 2014/0311466 | A1* | 10/2014 | Schuricht | F02M 26/32 123/568.12 |

(Continued)

FOREIGN PATENT DOCUMENTS

| | | | |
|---|---|---|---|
| JP | 2008-215336 | A | 9/2008 |
| JP | 2013-238143 | A | 11/2013 |
| KR | 10-2018-0136055 | A | 12/2018 |

*Primary Examiner* — Robert A Werner

(74) *Attorney, Agent, or Firm* — Mintz Levin Cohn Ferris Glovsky and Popeo, P.C.; Peter F. Corless

(57) ABSTRACT

An EGR cooler includes a tube assembly formed by stacking a plurality of tubes in which exhaust gas flows and a cover plate having a mounting portion formed concavely to mount the tube assembly thereon. A baffle is mounted at the tube assembly and adjusts flow of coolant inflow from a cylinder block. An inlet cover is installed on a first side of an outer surface of the cover plate to supply the exhaust gas to each tube and an outlet cover is installed on a second side of outer surface of the cover plate to exhaust the exhaust gas from each tube. At least one coolant passage in which the coolant flows is formed between the plurality of tubes.

14 Claims, 12 Drawing Sheets

(56) References Cited

U.S. PATENT DOCUMENTS

| | | | | |
|---|---|---|---|---|
| 2014/0373517 | A1* | 12/2014 | Sweet | F02M 26/32 60/324 |
| 2017/0152815 | A1 | 6/2017 | Peters et al. | |
| 2017/0205153 | A1* | 7/2017 | Hermida Domínguez | F28D 21/0003 |
| 2017/0218888 | A1* | 8/2017 | Ohrem | F02M 26/31 |
| 2017/0276094 | A1 | 9/2017 | Sheth et al. | |
| 2017/0370329 | A1* | 12/2017 | Chun | F28F 1/02 |
| 2018/0238276 | A1* | 8/2018 | Jeong | F28D 9/0031 |
| 2020/0102917 | A1* | 4/2020 | Son | F02M 26/28 |

* cited by examiner

EGR COOLER AND ENGINE SYSTEM HAVING THE SAME

CROSS-REFERENCE TO RELATED APPLICATION

This application claims priority to and the benefit of Korean Patent Application No. 10-2019-0019757 filed on Feb. 20, 2019, the entire contents of which are incorporated herein by reference.

BACKGROUND

(a) Field of the Invention

The present invention relates to an exhaust gas recirculation (EGR) cooler and an engine system having the same, and more particularly, to an EGR cooler installed in a cylinder block and an engine system having the same.

(b) Description of the Related Art

Nitrous oxide (NOx) contained in exhaust gas emitted from vehicles are restricted as main air pollutants, and research has been conducted to reduce emission of NOx. An exhaust gas recirculation (EGR) system is a system installed in a vehicle to reduce harmful exhaust gases. Generally, NOx is increased when the proportion of air in a mixer is high and combustion is good. Therefore, the EGR system mixes a portion (for example, about 5% to 20%) of exhaust gas discharged from an engine again in the mixer to reduce the amount of oxygen in the mixer and obstruct combustion, thereby suppressing the generation of NOx.

A low pressure exhaust gas recirculation (LP-EGR) device is a typical EGR system. The LP-EGR device recirculates exhaust gas that has passed through a turbine of a turbocharger to an intake passage at a front stage of a compressor. The EGR system also includes a cooler. Recirculated exhaust gas is cooled by the cooler and supplied to a combustion chamber 21. The related art EGR cooler includes a cooling structure installed inside a separate housing, requires various components such as a nipple, or the like, for connecting a recirculation line 52 through which a recirculating gas flows outside of the housing, and incurs high manufacturing cost of a vehicle due to an increase in length of the recirculation line 52. Also, since it is difficult to firmly fix the EGR cooler inside the vehicle, the EGR cooler housing wobbles, while the vehicle is being driven, causing excessive vibration.

The above information disclosed in this section is merely for enhancement of understanding of the background of the invention and therefore it may contain information that does not form the prior art that is already known in this country to a person of ordinary skill in the art.

SUMMARY

The present invention provides an exhaust gas recirculation (EGR) cooler having advantages of reducing manufacturing cost of a vehicle. Further, the present invention provides an EGR cooler having advantages of improving cooling efficiency of exhaust gas.

An EGR cooler an exemplary embodiment of the present invention may include a tube assembly formed by stacking a plurality of tubes in which exhaust gas flows; a cover plate that has a mounting portion formed concavely to mount the tube assembly; a baffle mounted at the tube assembly and configured to adjust flow of coolant inflow from a cylinder block; an inlet cover installed on a first side of an outer surface of the cover plate to supply the exhaust gas to the tube; an outlet cover installed on a second side of outer surface of the cover plate to exhaust the exhaust gas from the tube; wherein at least one coolant passage in which the coolant flows may be formed between the plurality of tubes.

The tube assembly may include a fixation member for fixing the tube. The tube may include at least on cooling fin for cooling the exhaust gas; and a guide protrusion for guiding a position of the cooling fin. At least one gap protrusion for adjusting a distance between the neighboring tubes may be formed in the tube. The tube may include a cooling portion that forms an exhaust gas passage; an inlet curved surface portion formed to be rounded from a first end of the cooling portion toward the cover plate; and an outlet curved surface portion formed to be rounded from a second end of the cooling portion toward the cover plate.

The tube may include an inlet inclination portion formed at an end of the inlet curved surface portion to be opened to allow the exhaust gas to flow into the exhaust gas passage of the cooling portion; and an outlet inclination portion formed at an end of the outlet curved surface portion to be opened to exhaust the exhaust gas from the exhaust gas passage of the cooling portion. A bending portion may be formed at an edge of a flange portion formed on an outer periphery of the cover plate.

A first inclination portion may be formed to be inclined at a first side of the mounting portion, and a second inclination portion may be formed to be inclined at a second side of the mounting portion. An inlet cover engaging portion may be formed in the inlet cover corresponding to the first inclination portion, and an outlet cover engaging portion may be formed in the outlet cover corresponding to the second inclination portion. A position protrusion may be formed in the cover plate, an engaging aperture may be formed in the inlet cover and the outlet cover corresponding to the position protrusion, and the inlet cover and the outlet cover may be guided by inserting the position protrusion into the engaging aperture.

An engine system according to another exemplary embodiment of the present invention may include an engine having a cylinder block in which a mounting space may be formed, a coolant inlet for flowing coolant into the mounting space, and a coolant inlet for exhausting the coolant from the mounting space; an intake line in which external air supplied to the engine flows; an exhaust line in which exhaust gas generated in the engine flows; an EGR line branched off from the exhaust line and merged into the intake line; and an EGR cooler configured to cool the exhaust gas flowing through the EGR line. The EGR cooler may include a tube assembly formed by stacking a plurality of tubes in which exhaust gas flows, and mounted in the mounting space; a cover plate having a mounting portion formed concavely to mount the tube assembly, and covering the mounting space; a baffle mounted at the tube assembly and configured to adjust flow of coolant inflow from the coolant inlet; an inlet cover installed on a first side of the cover plate to supply the exhaust gas to the tube; and an outlet cover installed on a second side of the cover plate to exhaust the exhaust gas from the tube; wherein coolant passages in which the coolant flows may be formed between the tube assembly and the mounting space, between each tube and between the tube assembly and the cover plate.

The tube assembly may include a fixation member for fixing the tube. The tube may include at least a cooling fin for cooling the exhaust gas; and a guide protrusion for guiding a position of the cooling fin. At least one gap protrusion for adjusting a distance between the neighboring tubes may be formed in the tube. The tube may include a cooling portion that forms an exhaust gas passage; an inlet curved surface portion formed to be rounded from a first end of the cooling portion toward the cover plate; and an outlet curved surface portion formed to be rounded from a second end of the cooling portion toward the cover plate.

The tube may include an inlet inclination portion formed at an end of the inlet curved surface portion to be opened to allow the exhaust gas to flow into the exhaust gas passage of the cooling portion; and an outlet inclination portion formed at an end of the outlet curved surface portion to be opened to exhaust the exhaust gas from the exhaust gas passage of the cooling portion. A bending portion may be formed at an edge of a flange portion formed on an outer periphery of the cover plate.

A first inclination portion may be formed to be inclined at a first side of the mounting portion, and a second inclination portion may be formed to be inclined at a second side of the mounting portion. An inlet cover engaging portion may be formed in the inlet cover corresponding to the first inclination portion, and an outlet cover engaging portion may be formed in the outlet cover corresponding to the second inclination portion. A position protrusion may be formed in the cover plate, an engaging aperture may be formed in the inlet cover and the outlet cover corresponding to the position protrusion, and the inlet cover and the outlet cover may be guided by inserting the position protrusion into the engaging aperture.

According to an exemplary embodiment of the present invention as described above, since the EGR cooler may include a tube having a round shaped curved surface portion at both ends thereof, it may be possible to increase cooling efficiency of exhaust gas. Further, since the EGR cooler may be made of aluminum material, material cost and entire weight may be reduced and cooling efficiency may be improved.

BRIEF DESCRIPTION OF THE DRAWINGS

The above and other features of the present invention will now be described in detail with reference to exemplary embodiments thereof illustrated in the accompanying drawings which are given hereinbelow by way of illustration only, and thus are not limitative of the present invention, and wherein.

DETAILED DESCRIPTION

Figure 1:
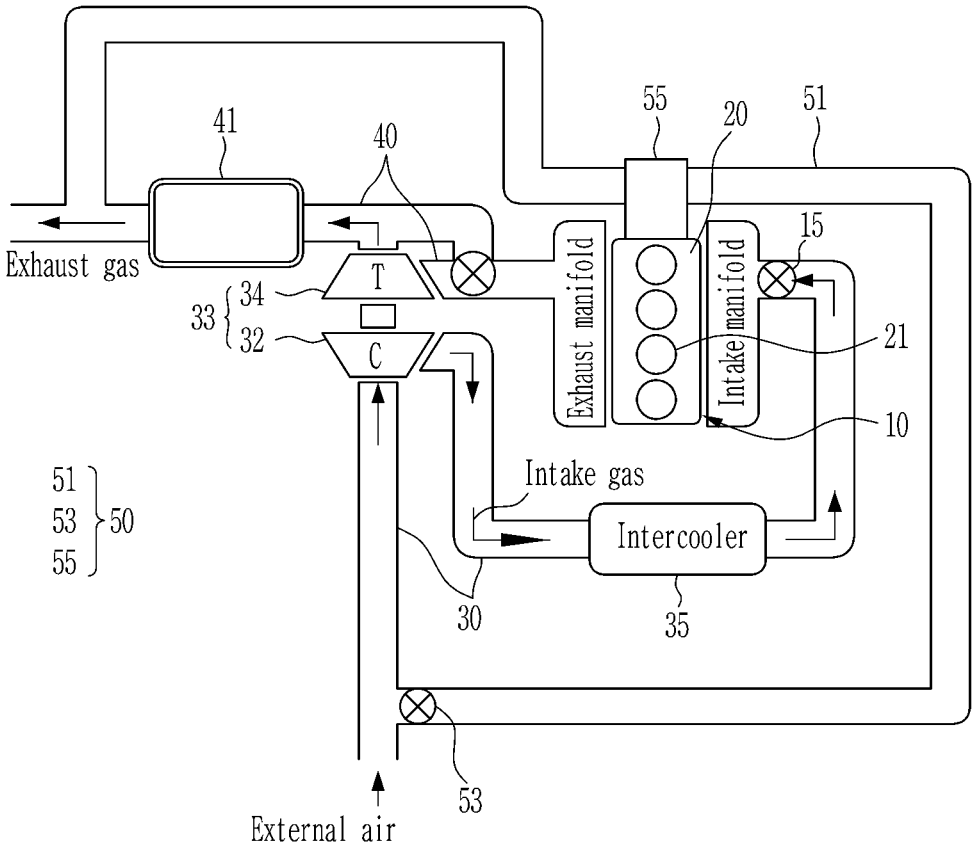
FIG. 1 is a view illustrating a configuration of an engine system to which an exhaust gas recirculation (EGR) cooler according to an exemplary embodiment of the present invention is applied.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

The present invention will be described more fully hereinafter with reference to the accompanying drawings, in which exemplary embodiments of the invention are shown. As those skilled in the art would realize, the described exemplary embodiments may be modified in various different ways, all without departing from the spirit or scope of the present invention. In order to clarify the present invention, parts irrespective of description will be omitted, and similar reference numerals are used for the similar parts throughout the specification. The size and thickness of each element are arbitrarily illustrated in the drawings, and the present invention is not necessarily limited thereto. In the drawings, the thickness of layers, films, panels, regions, etc., are exaggerated for clarity.

Figure 2:
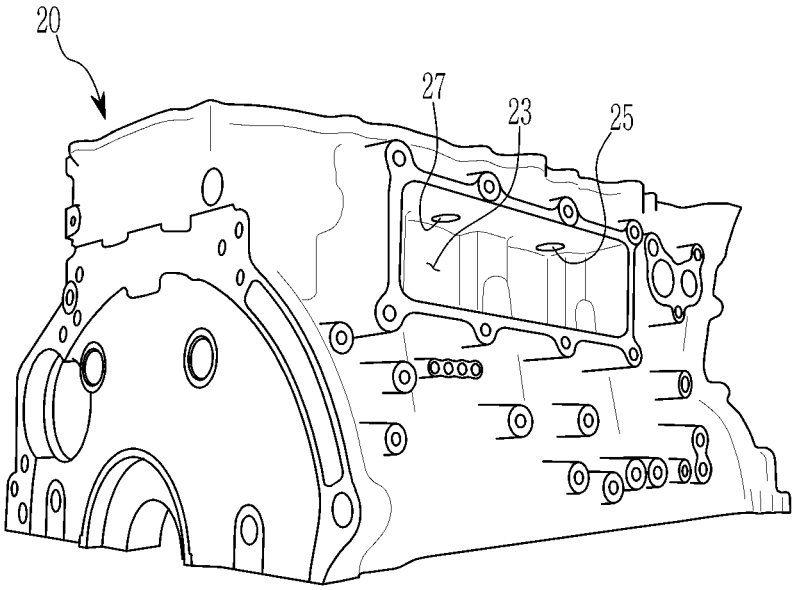
FIG. 2 is a partial perspective view illustrating a configuration of a cylinder block according to an exemplary embodiment of the present invention.

First, an engine system to which an exhaust gas recirculation (EGR) cooler according to an exemplary embodiment of the present invention is applied will be described with reference to FIG. 1. FIG. 1 is a view illustrating a configuration of an engine system to which an exhaust gas recirculation (EGR) cooler according to an exemplary embodiment of the present invention is applied. And FIG. 2 is a partial perspective view illustrating a configuration of a cylinder block according to an exemplary embodiment of the present invention.

Referring to FIG. 1, an engine system according to an exemplary embodiment of the present invention may include an engine 10, an intake line 30, an exhaust line 40 and an exhaust gas recirculation (EGR) device 50. The engine 10 transforms chemical energy to mechanical energy by combustion of a mixture of fuel and air. The engine 10 may include a cylinder block 20, an intake manifold 13, a throttle valve 15 and an exhaust manifold 17. In FIG. 1 and referring to FIG. 2, at least one combustion chamber 21, a mounting space 23, a coolant inlet 25 and a coolant outlet 27 may be formed in the cylinder block 20.

In particular, the combustion chamber 21 may be configured to generate driving torque by burning fuel. Although the drawings illustrate that the engine 10 includes four combustion chambers 21, the number of the combustion chambers 21 is not limited thereto. The mounting space 23 may be formed at the cylinder block 20. The coolant inlet 25 may be formed on inner side of the mounting space 23. The coolant cooling the cylinder block may flow into the mounting space 23 through the coolant inlet 25. The coolant outlet 27 may be formed on the inner side of the mounting space 23. The coolant which flows in the mounting space 23 may be discharged to a water jacket (not shown) of the cylinder block through the coolant outlet 27. One side of the mounting space 23 may be open.

Additionally, external air flowing through the intake line may be supplied to the combustion chamber 21 through the intake manifold 13. The throttle valve 15 may be installed in the intake line 30 at upstream from the intake manifold 13. The amount of air supplied to the intake manifold 13 may be adjusted by adjusting an opening degree of the throttle valve 15. The exhaust manifold 17 may be connected with the combustion chamber 21. The exhaust gas generated in the combustion chamber 21 may be exhausted through the exhaust manifold 17. The engine 10 may be a gasoline direct injection (GDI) engine that directly injects fuel into the gasoline engine, but not limited thereto.

The intake line 30 may be connected with the intake manifold 13. An air cleaner 31, a compressor 32 and an intercooler 35 may be installed in the intake line 30. External air may be supplied to the intake manifold 13 through the intake line 30. The air cleaner 31 may be disposed in the intake line 30. The air cleaner 31 may be configured to filter external air flowing into the intake line 30 from outside the vehicle. The engine system according to the present invention may further include a turbocharger 33 configured to supply compressed air into the combustion chamber 21.

In particular, the turbocharger 33 may be configured to compress an intake gas (external air+recirculation gas) flowing through the intake line 30, and the compressed intake gas may be supplied to the combustion chamber 21. The turbocharger 70 may include a turbine 71 provided in the exhaust line 40 and rotated by the exhaust gas discharged from the combustion chambers 21 and a compressor 72 cooperatively rotated with the turbine 71 and configured to compress the intake gas. The intercooler 35 may be installed in the intake line 30 at a downstream from the compressor 32. The intercooler 35 may be configured to cool the intake gas compressed by the compressor 32 having high temperature and high pressure. The exhaust line 40 may be connected with the exhaust manifold 17 and the EGR device 50. The turbine 34 and a catalytic converter 41 may be installed in the exhaust line 40. The exhaust gas exhausted from the combustion chamber 21 may flow through the exhaust line 40. Further, some of the exhaust gas may flow into the EGR device 50 from the exhaust line 40.

The catalytic converter 41 may be installed in the exhaust line 40 downstream from the turbine 34. The catalytic converter 41 may be configured to purify harmful material in the exhaust gas that is exhausted from the combustion chamber 21. The catalytic converter 41 may be a three-way catalyst (TWC). The three-way catalyst may be configured to reduce CO, HC and NOx included in exhaust gas of a gasoline engine. The three-way catalyst may be activated at a predetermined temperature or greater to convert carbon monoxide (CO) and hydrocarbon (HC) into harmless components through oxidation reaction and NOx may be converted into harmless components through reduction reaction.

The EGR device 50 may include an EGR line 51, an EGR valve 53 and an EGR cooler 55. The EGR device 50 may be a low pressure exhaust gas recirculation apparatus (LP-EGR) device, but not limited thereto. The EGR line 51 may be branched off from the exhaust line 40 downstream from the catalytic converter 41 and merged into the intake line 30 between the compressor 32 and the air cleaner 31. Some of the exhaust gas (hereinafter, will be referred to as a 'recirculation gas") flowing through the exhaust line 40 may flow into the EGR line 51. The exhaust gas flowing through the EGR line 51 may be supplied to the combustion chamber 21 through the intake line 30 and the intake manifold 13.

The EGR cooler 55 may be installed in the EGR line 51. Particularly, the EGR cooler 55 may be installed at the cylinder block 20. The EGR cooler 55 may be configured to cool the exhaust gas flowing through the EGR line 51. The EGR valve 53 may be installed in the EGR line 51 downstream from the EGR cooler 55. The EGR valve 53 may be installed in a position where the intake line 30 and the EGR line 51 are joined. The amount of the recirculation gas may be adjusted by adjusting the opening degree of the EGR valve 53.

Figure 3:
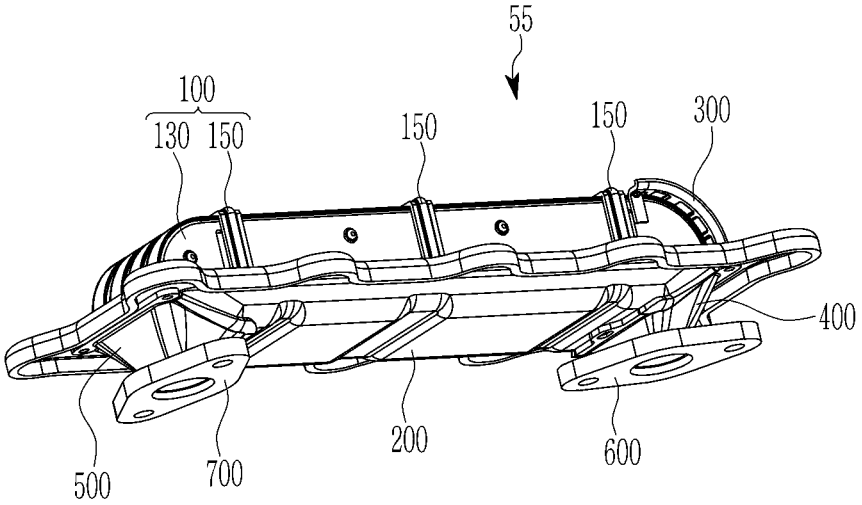
FIG. 3 is a perspective view illustrating a configuration of an EGR cooler according to an exemplary embodiment of the present invention.

Hereinafter, the EGR cooler according to an exemplary embodiment of the present invention will be described in detail with reference to FIG. 3 to FIG. 11. FIG. 3 is a perspective view illustrating a configuration of an EGR cooler according to an exemplary embodiment of the present invention. As shown in FIG. 3, the EGR cooler 55 according to an exemplary embodiment of the present invention may include a tube assembly 100, a cover plate 200, a baffle 300, an inlet cover 400, an outlet cover 500, an inlet flange 600 and an outlet flange 700.

In the specification, the direction in which the inlet cover 400 is installed based on the cover plate 200 is referred to as a first side, and the direction in which the outlet cover 500 is installed is referred to as a second side. The tube assembly 100 may be mounted in the mounting space 23 formed in the cylinder block 20. The tube assembly 100 may include a tube 110 through which exhaust gas may flow and a fixation member 150. The tube 110 and the fixing member 150 may be made of aluminum material. A plurality of the tubes 110 may be stacked in a vertical direction, and an outer surface of a plurality of tubes 110 may be surrounded by the fixing member 150 to fix the plurality of tubes 110. The fixing member 150 may be welded to the outer surface of the stacked tubes 110 to fix the tubes 110. A plurality of fixing members 150 may be provided. Coolant passages may be formed between the plurality of tubes 110 and between the tube assembly 100 and the inner surface of the mounting space 23.

A detailed description of the tube 110 will be described with reference to FIG. 4 and FIG. 5. The cover plate 200 may be installed on the outer surface of the cylinder block 20 to close the mounting space 23. In other words, the cover plate 200 may cover the open side of the mounting space 23. The cover plate 200 may be made of aluminum material. The tube assembly 100 may be mounted at the cover plate 200. The cover plate 200 will be described in detail with reference to FIG. 6 and FIG. 7.

At least a part of the surfaces of the cover plate 200 and the tube assembly 100 facing each other may be spaced apart from each other, and a coolant passage may be formed between the spaced surfaces. In other words, the coolant passage may be formed between the plurality of tubes 110, between the inner surface of the tube assembly 100 and the mounting space 23, and between the cover plate 200 and the spaced surfaces of the tube assembly 100. Coolant flowing into the mounting space of the cylinder block 20 through the coolant inlet 25 may flow in the coolant passage. The exhaust gas flowing in the tube 110 may be cooled by the coolant flowing in the coolant passage.

The baffle 300 may be provided at both ends of the tube assembly 100. The baffle 300 may be made of aluminum material. A flow of the coolant inflow to coolant passage through the coolant inlet 25 of the cylinder block 20 may be adjusted by the baffle 300. The baffle 300 will be described in detail with reference to FIG. 8. The inlet cover 400 may be installed on a first side of the outer surface of the cover plate 200 and the outlet cover 500 may be installed on a second side of the outer surface of the cover plate 200. The inlet cover 400 and the outlet cover 500 may be made of aluminum material. The inlet cover 400 and the outlet cover 500 may be described in detail with reference to FIG. 9 to FIG. 11. The inlet flange 600 may be installed outside the inlet cover 400 and the outlet flange 700 may be installed outside the outlet cover 500. The inlet flange 600 and the outlet flange 700 may be made of aluminum material. The inlet flange 600 and the outlet flange 700 may be connected with the EGR line 51, respectively.

Hereinafter, a flow of the exhaust gas flowing through the EGR line 51 will be described. The exhaust gas flowing through the EGR line 51 may flow into the tubes 110 through the inlet flange 600, inlet cover 400 and the cover plate 200. The exhaust gas may be cooled by the coolant flowing through the coolant passage. Then, the exhaust gas may be resupplied into the EGR line 51 through the cover plate 200, the outlet cover 500 and the outlet flange 700.

Figure 4:
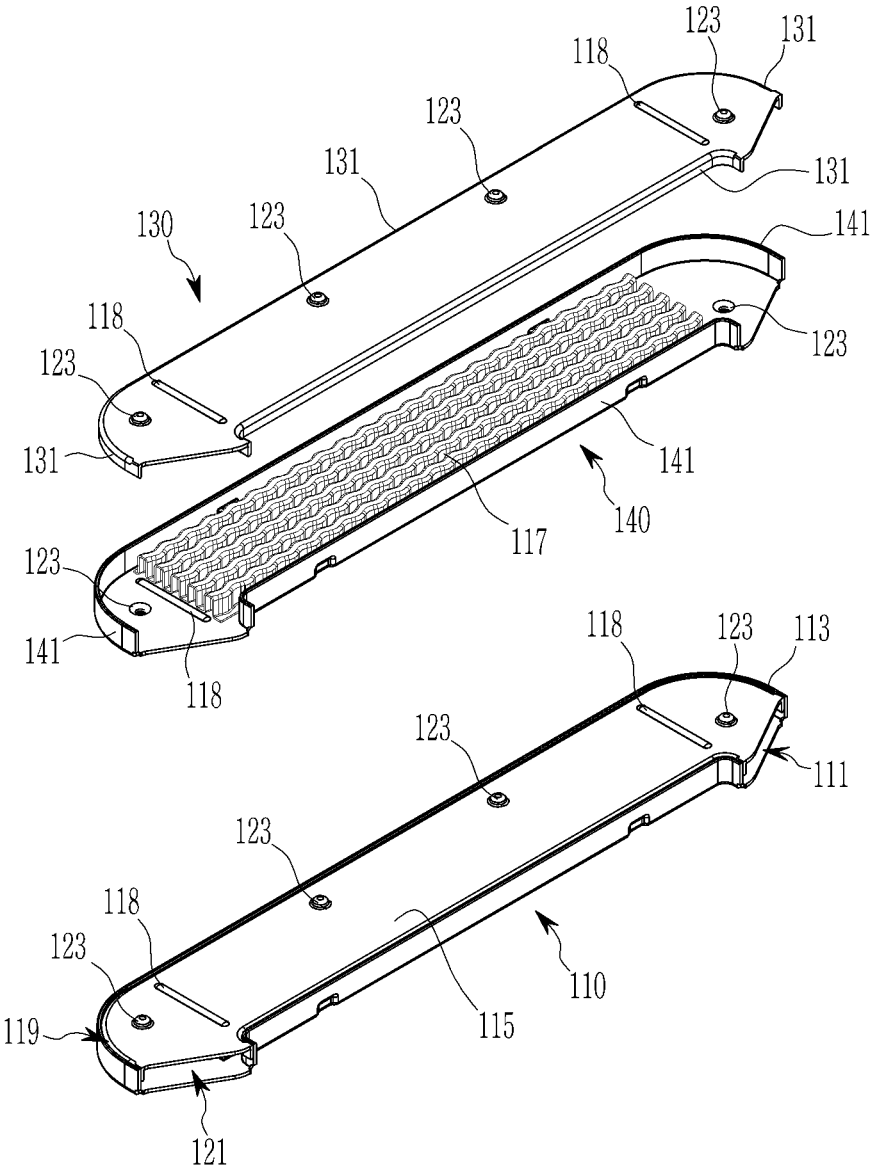
FIG. 4 is a perspective view illustrating a configuration of a tube according to an exemplary embodiment of the present invention.

Referring to FIG. 4 to FIG. 11, the components of the EGR cooler 55 according to an exemplary embodiment of the present invention, will be described in more detail. FIG. 4 is a perspective view illustrating a configuration of a tube according to an exemplary embodiment of the present invention. And FIGS. 5A and 5B are top plan views a configuration of a gap protrusion according to an exemplary embodiment of the present invention. Referring to FIG. 4, each tube 110 may be formed in a substantially rectangular shape. The exhaust gas may flow inside of each tube 110. A plurality of tubes 110 may be stacked to form a tube assembly 100 (refer to FIG. 3).

Each tube 110 may be formed by assembling a first tube partition 130 and a second tube partition 140, and an exhaust passage is formed therein. The tube 110 may include an inlet inclination portion 111, an inlet curved surface portion 113, a cooling portion 115, a cooling fin 117, an outlet curved surface portion 119, an outlet inclination portion 121 and a gap protrusion 123. An exhaust gas passage may be formed in the cooling portion 115. An inlet curved surface portion 113 may be formed to be rounded from a first end of the cooling portion 115 toward the cover plate 200. And outlet curved surface portion 123 may be formed to be rounded from a second end of the cooling portion 115 toward the cover plate 200. An inlet inclination portion 111 may be formed at an end of the inlet curved surface portion 113 to be opened to allow the exhaust gas to flow into the exhaust gas passage of the cooling portion 115. And an outlet inclination portion 121 may be formed at an end of the outlet curved surface portion 123 to be opened to exhaust the exhaust gas from the exhaust gas passage of the cooling portion 115.

A cross section of the inlet inclination portion 111 may be formed in a substantially rectangular shape. The inlet inclination portion 111 may be formed to be inclined at a predetermined angle in the direction opposite to the cover plate 200. The inlet incision portion 111 may be open to allow the exhaust gas to inflow from the inlet cover 400 into the tube 110. The exhaust gas may flow into the exhaust gas passage of the tube 110 through the inlet inclination portion 111. The inlet curved surface portion 113 may be formed in a rounded shape. The exhaust gas flowing into the inlet inclination portion 111 through the inlet curved surface portion 113 may flow into the cooling portion 115. Since the inlet curved surface portion 113 has a rounded shape, the flow resistance of the exhaust gas may be reduced and the exhaust gas may flow more smoothly into the cooling portion 115.

The cooling portion 115 may be formed in a central portion of the tube 110. The cooling fin 117 may be formed in the cooling portion 115. A plurality of cooling fins 117 may be formed and may be spaced apart from each other, and the cooling fin 117 may be formed in a wavy shape. The cooling fin 117 may be integrally formed with the cooling portion 115. Alternatively, the cooling fin 117 may be separately provided from the cooling part 115, and the cooling fin 117 and the cooling part 115 may be assembled by welding or fitting. Since the cooling fin 117 may be formed in the cooling portion 115, the heat dissipation area of the exhaust gas flowing inside the cooling portion 115 may be increased. Accordingly, cooling efficiency of the exhaust gas flowing in the tube 110 may be improved.

The guide protrusion 118 for guiding the position of the cooling fin 117 may be formed on both sides of the inner surface of the cooling portion 115. The guide protrusion 118 may be formed in pairs adjacent to the cooling fin 117. Additionally, the guide protrusion 118 may be provided on at least one of the inner surface of the first tube partition 130 and the inner surface of the second tube partition 140. The guide protrusion 118 may protrude or extend toward the inside of the cooling portion 115. The guide protrusion 118 may protrude inside and outside the cooling portion 115.

The outlet curved surface portion 119 may be formed in rounded shape. The exhaust gas flowing inside the cooling portion 115 may be exhausted to the outlet inclination portion 121 through the outlet curved surface portion 119. Since the outlet curved surface portion 119 has a rounded shape, the flow resistance of the exhaust gas may be reduced and the exhaust gas may be exhausted more smoothly. The cross section of the outlet inclination portion 121 may be formed in a substantially rectangular shape. The outlet inclination portion 121 may be formed to be inclined at a predetermined angle in the direction opposite to the cover plate 200. The outlet inclination portion 121 may be open to exhaust the exhaust gas circulating in the cooling portion 115. The exhaust gas cooled in the cooling portion 115 may be exhausted to the outlet cover 500 through the outlet curved surface portion 119 and the outlet inclination portion 121.

Figure 5A:
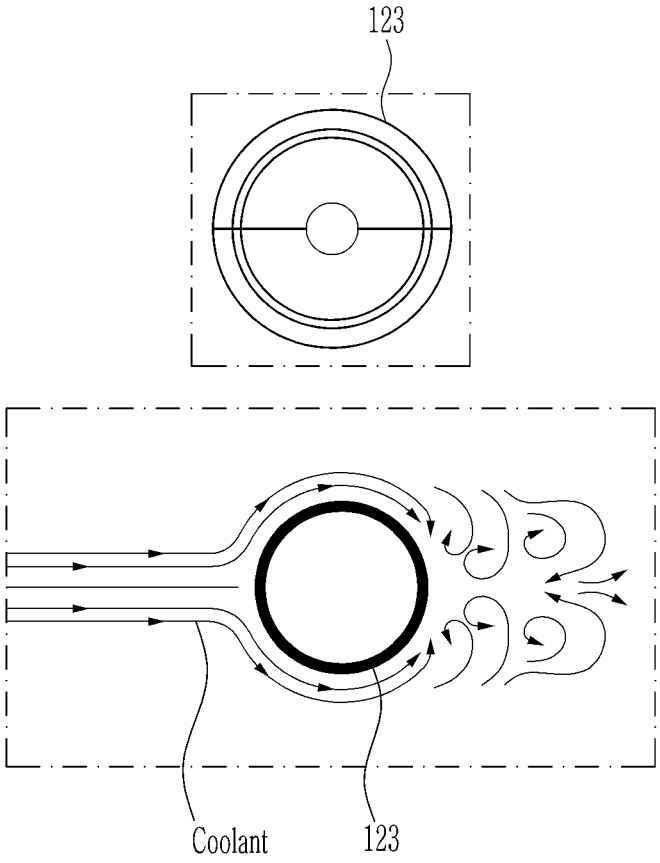
FIGS. 5A and 5B are top plan views a configuration of a gap protrusion according to an exemplary embodiment of the present invention.
Figure 5B:
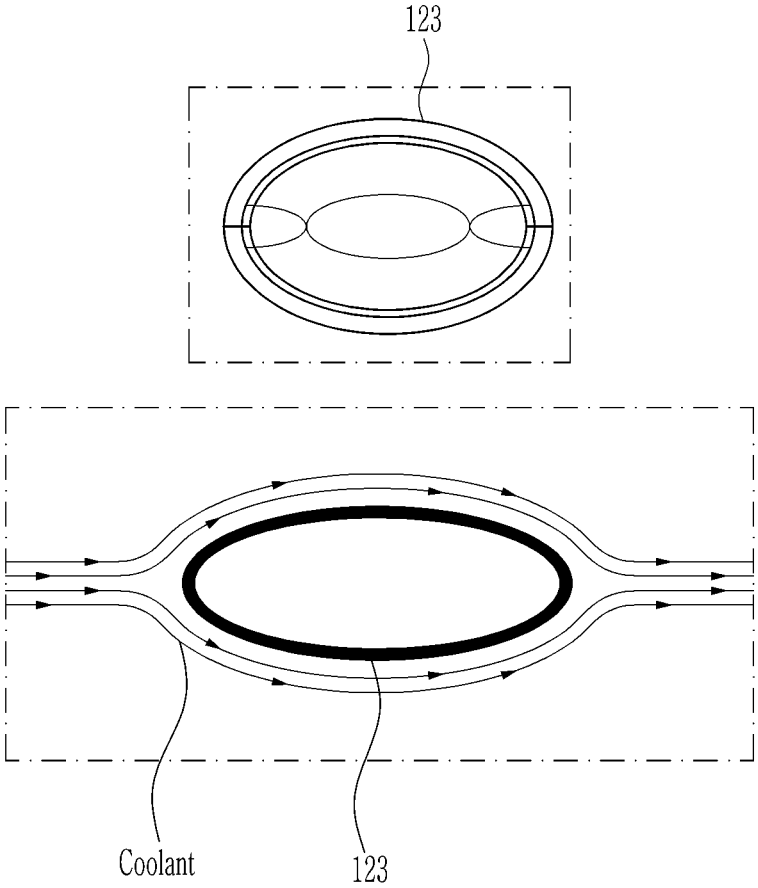

The gap protrusion 123 may be formed on the outer surfaces of the first tube partition 130 and the second tube partition 140, respectively. FIG. 4 shows four gap protrusions 123, which is merely an example, and a plurality of gap protrusions 123 may be provided. The gap protrusion 123 may be formed separately from the tube 110 by welding, or may be integrally formed with the tube 110. The gap protrusion 123 is shown in FIGS. 5A-5B, circular or elliptical, but is not limited thereto. The gap protrusion 123 may adjust flow of the coolant flowing in the coolant passage.

As shown in FIG. 5A, when the gap protrusion 123 is formed in a circular shape, the coolant may flow through the coolant passage formed between the adjacent tubes 110. At this time, since the coolant flows from upstream to downstream of the gap protrusion 123 and the coolant is formed in the vortex shape downstream from the gap protrusion 123, the coolant may be temporarily stagnated at a downstream of the gap protrusion 123.

As shown in FIG. 5B, when the gap protrusion 123 is formed in an elliptical shape with a longer length in the coolant flow direction, the flow of the coolant past the gap protrusion 123 and the flow of the coolant before passing through the gap protrusion 123 may be adjusted in the same manner. Further, a distance between the plurality of tubes 110 may be adjusted by the gap protrusion 123. In other words, when the plurality of tubes 110 are stacked to form the tube assembly 100, the distance between the plurality of tubes 110 by the gap protrusion 123 and the cross sectional area formed between plurality of tubes 110 may be adjusted. Accordingly, the cooling efficiency of the exhaust gas circulating in the tube 110 may be improved.

As described above, the tube 110 may be formed by assembling the first tube partition 130 and the second tube partition 140. The first tube partition 130 may be inserted into the second tube partition 140, and the contacting surface of the first tube partition 130 and the second tube partition 140 may be welded to form the tube 110. The first tube partition 130 and the second tube partition 140 may be closely fitted to minimize a gap between a contacting surface 131 of the first tube partition 130 and a contacting surface 141 of the second tube partition 140. By minimizing the gap as described above, it may be possible to reduce the material for the welding to fill the gap. Therefore, the production cost of tube 110 and the weight of tube 110 may be reduced. Additionally, the exhaust gas flowing inside the tube 110 may be prevented from leaking to the outside.

Figure 6:
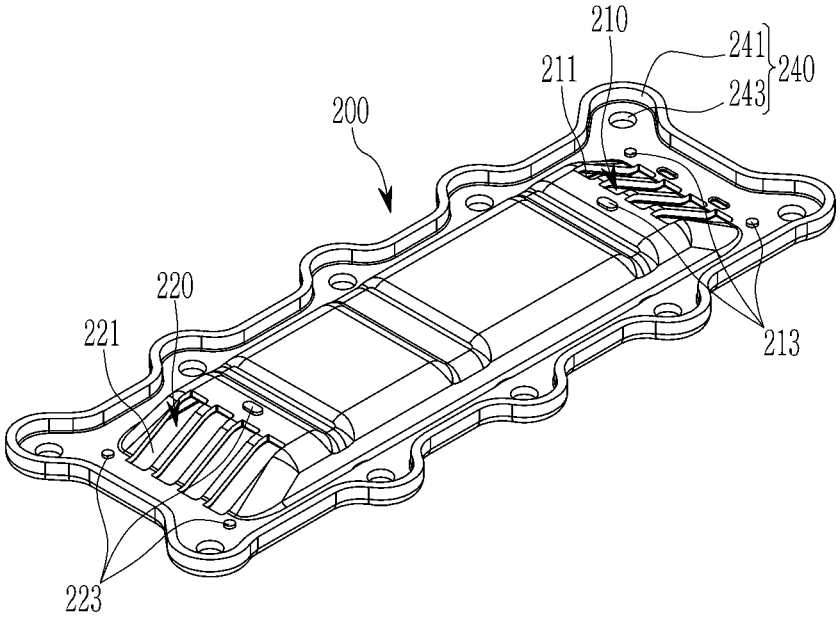
FIG. 6 and FIG. 7 are perspective views illustrating a configuration of a cover plate according to an exemplary embodiment of the present invention.
Figure 7:
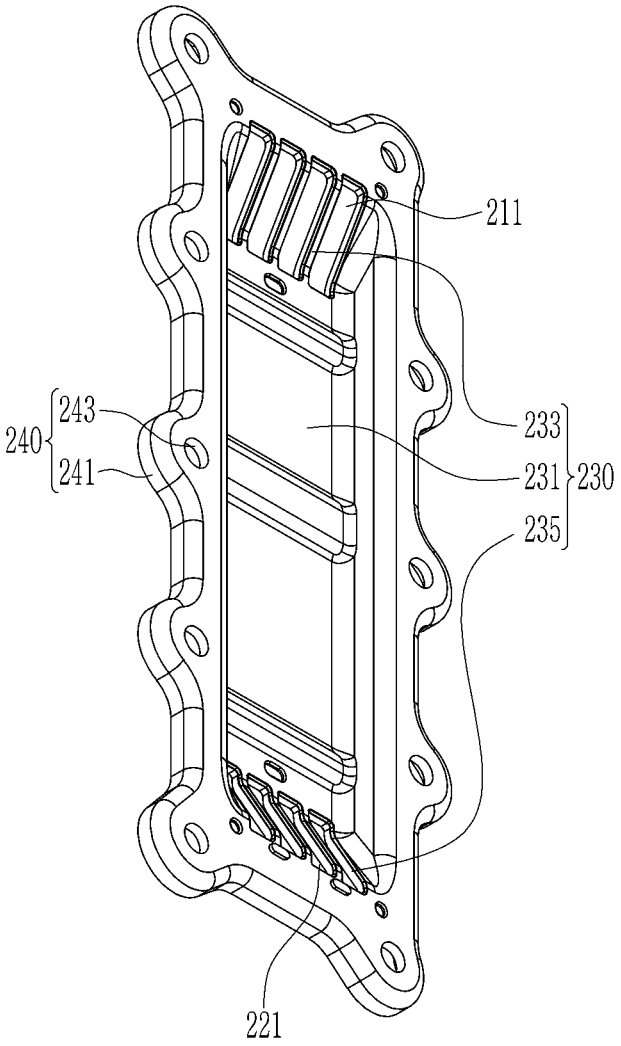

FIG. 6 and FIG. 7 are perspective views illustrating a configuration of a cover plate according to an exemplary embodiment of the present invention. FIG. 6 is a perspective view illustrating an outer surface of the cover plate 200 according to an exemplary embodiment of the present invention, and FIG. 7 is a perspective view illustrating an inner surface of the cover plate 200 according to an exemplary embodiment of the present invention.

The cover plate 200 according to an exemplary embodiment of the present invention may be mounted at an outer surface of the cylinder block 20 and cover the mounting space 23. The tube assembly 100 may be mounted at an inner surface of the cover plate 200. The inlet cover 400 may be mounted at a first side of the outer surface of the cover plate 200, and the outlet cover 500 may be mounted at a second side of the outer surface of the cover plate 200. The cover plate 200 may be manufactured by pressing metal plate.

Referring to FIG. 6 and FIG. 7, the cover plate 200 may include an inlet portion 210, an outlet portion 220, a mounting portion 230 and a flange portion 240. Referring to FIG. 6, the inlet portion 210 may be formed on a first side of the outer surface of the cover plate 200. The inlet portion 210 may be inclined at a predetermined angle from a first side of the cover plate 200 toward the tube assembly 100. The inlet portion 210 may include an inflow aperture 211 and a position protrusion 213.

The inflow aperture 211 may be formed in the same shape as the inlet inclination portion 111 of the tube 110. Additionally, the number of inflow apertures 211 is equal to the number of the tubes 110 of the tube assembly 100. The exhaust gas inflow from the inlet cover 400 may be distributed to the inlet apertures 221 and may flow into each tube 110. The position protrusion 213 may protrude toward the outer side of the cover plate 200 (e.g., opposite side of the mounting space), and may be formed adjacent to the inflow aperture 211. FIG. 6 shows three position protrusions 213, but this is merely an example and a plurality of position protrusions 213 may be provided. The number of the position protrusions 213 may be the same as the number of the position grooves 411 of the inlet cover 400 to be described later. The position protrusion 213 may guide the engagement position of the inlet cover 400.

The outlet portion 220 may be formed on a second side of the outer surface of the cover plate 200. The outlet portion 220 may be inclined at a predetermined angle from a first side of the cover plate 200 toward the tube assembly 100. The exhaust gas cooled in the tubes 110 may be exhausted outside through the outlet portion 220. The outlet portion 220 may include an outflow aperture 221 and a position protrusion 223. The outflow aperture 221 may formed in the same shape of the outlet inclination portion 121 of the tube 110. The number of the outflow aperture 221 is equal to the number of the tubes 110 of the tube assembly 100. The exhaust gas cooled in the tubes 110 may be exhausted to the outlet cover 500 through the outflow aperture 221.

The position protrusion 223 may be formed adjacent to the outflow aperture 221. FIG. 6 shows three position protrusions 223, but this is merely an example and a plurality of position protrusions 223 may be provided. The number of the position protrusions 223 may be the same as the number of engaging apertures 511 of the inlet cover 400 to be described later. Since the inlet portion 210 and the outlet portion 220 are inclined, the coolant passage formed between the tube assembly 100 and the cover plate 200 may be proximate to the inlet cover 400 and the outlet cover 500. Accordingly, cooling efficiency of the exhaust gas flowing into the tubes 110 may be improved.

Further, the distribution of the exhaust gas to each tube 110 of the tube assembly 100 and the exhaust gas exhausted from the tube 110 may be facilitated. When the coolant passage and the inlet cover 400 and the outlet cover 500 are adjacent to each other as described above, the inlet cover 400 and the outlet cover 500 may be cooled more easily, and the durability of the inlet cover 400 and the outlet cover 500 may be improved.

Referring to FIG. 7, the mounting portion 230 may be formed concavely in the overall view and formed on an inner surface of the cover plate 200. The mounting portion 230 may include a center portion 231, a first inclination portion 233 and a second inclination portion 235. The tube assembly 100 may be mounted in the mounting portion 230. The first inclination portion 233 may be inclined toward the tube assembly 100 from a first side of the inner surface of the cover plate 200. The first inclination portion 233 may be formed between the plurality of inflow apertures 211. When the tube assembly 100 is engaged with the cover plate 200, the inlet inclination portion 111 of each tube 110 may be inserted into each inflow aperture 211.

The second inclination portion 235 may be inclined toward the tube assembly 100 from a second side of the inner surface of the cover plate 200. The first inclination portion 233 and the second inclination portion 235 may be formed to be symmetrical about the center portion 231. The second inclination portion 235 may be formed between the plurality of outflow apertures 221. When the tube assembly 100 is engaged with the cover plate 200, the outlet inclination portion 121 of each tube 110 may be inserted into each outflow aperture 221. When the tube assembly 100 is mounted in the cover plate 200, the central portion of the tube 110 may be positioned in the center portion 211, the inlet inclination portion 111 may be inserted into the inflow aperture 211, and the outlet inclination portion 121 may be inserted into the outflow aperture 221.

The flange portion 240 may be formed on an outer periphery of the cover plate 200. The cover plate 200 and the cylinder block 20 may be engaged through the flange portion 240. The flange portion 240 may include a bending portion 241 and an engage aperture 243. The bending portion 241 may be formed at the edge of the flange portion 240. In other words, the bending portion 241 may be bent outward from the outermost portion of the flange portion 240. The stiffness of the cover plate 200 may be increased by the bending portion 241. The engage aperture 243 may be formed on the flange portion 240. A plurality of engage apertures 243 may be provided, and the number of the engage apertures 243 is equal to the number of engage aperture (not shown) formed in the cylinder block. After mounting the cover plate 200 on the cylinder block 20, an engage bolt through the cover engage aperture 243 (e.g., bore) may be screwed into the cylinder block's engage aperture (e.g., bore), to engage the cover plate 200 with the cylinder block 20.

Figure 8:
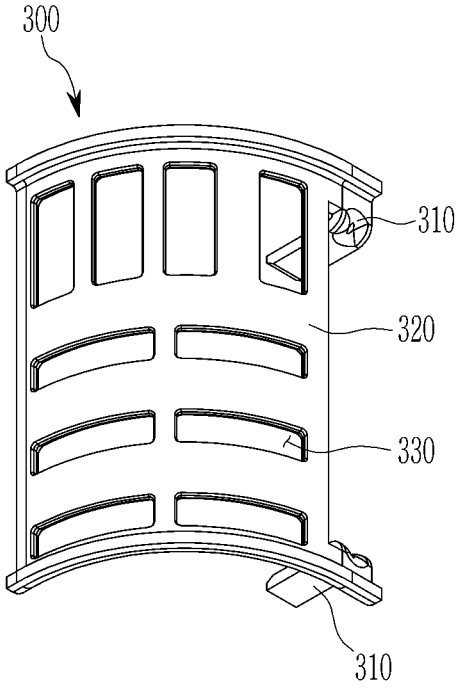
FIG. 8 is a perspective view illustrating a configuration of a baffle according to an exemplary embodiment of the present invention.

FIG. 8 is a perspective view illustrating a configuration of a baffle according to an exemplary embodiment of the present invention. Referring to FIG. 8, the baffle 300 according to an exemplary embodiment of the present invention has a generally rounded shape and may be installed at a first end of the tube assembly 100 (e.g., at the inlet side where the coolant flows in). In other words, the baffle 300 may be formed corresponding to the inlet curved surface portion 113 of the tube 110.

The baffle 300 may include an inserting portion 310, a welding portion 320 and a passage portion 330. The inserting portion 310 may be bent toward the cover plate 200 at both ends of the baffle 300. The welding portion 320 may be formed in rounded shape (or partial arc shape). When the baffle 300 is engaged with the tube assembly 100, the inserting portions 310 may be inserted into the exterior of the tube assembly 100, then the welding portion 320 may be welded to the tube assembly 100.

The passage portion 330 is an aperture formed in the baffle 300, and formed in the welding portions 320. When the baffle 300 is engaged with the tube assembly 100, the passage portion 330 may be positioned to correspond to the coolant passage formed between the neighboring tubes 110. In particular, ten passage portions 330 may be formed. The coolant flowing through the coolant inlet 25 of the cylinder block 20 may flow into the coolant passage through the passage portion 330. Since the passage portions 330 are positioned to correspond to the coolant passages, the coolant may flow more smoothly into the coolant passage.

Figure 9:
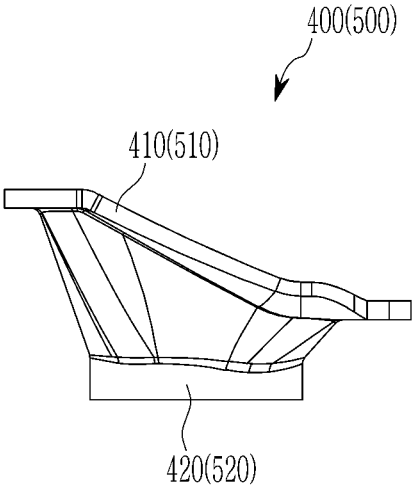
FIG. 9 and FIG. 10 are perspective view illustrating a configuration of an inlet cover and an outlet cover according to an exemplary embodiment of the present invention.
Figure 10:
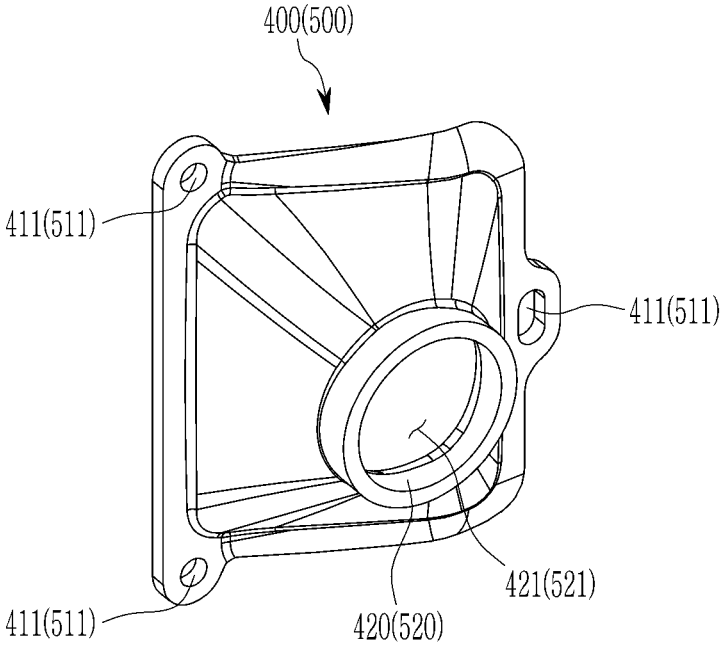
Figure 11:
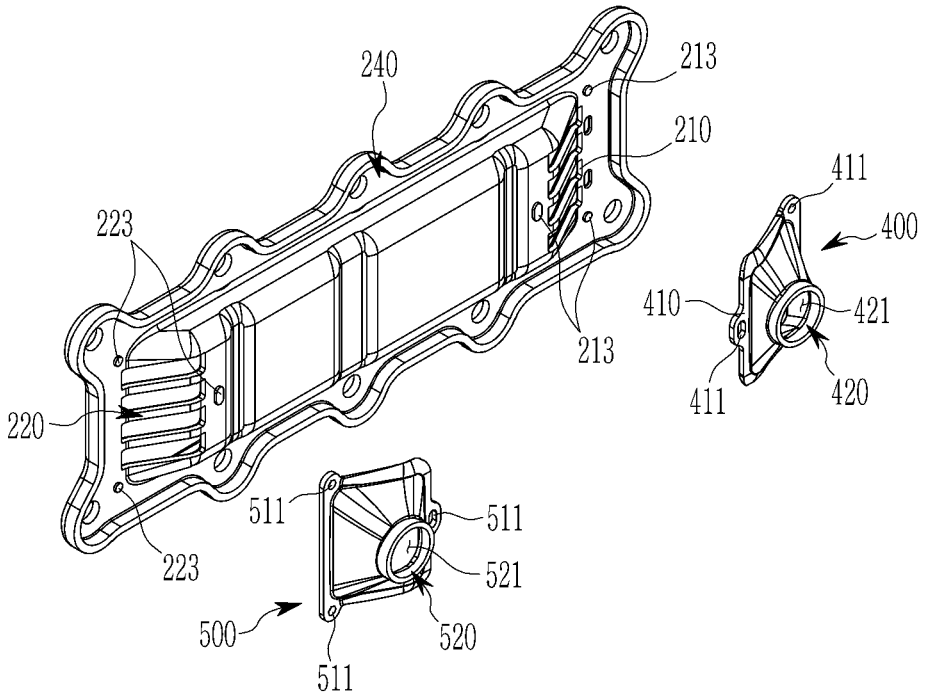
FIG. 11 is a drawing illustrating a relationship of a cover plate, an inlet cover and an outlet cover according to an exemplary embodiment of the present invention.

FIG. 9 and FIG. 10 are perspective view illustrating a configuration of an inlet cover and an outlet cover according to an exemplary embodiment of the present invention. And FIG. 11 is a drawing illustrating a relationship of a cover plate, an inlet cover and an outlet cover according to an exemplary embodiment of the present invention. The inlet cover and the outlet cover may be formed with symmetrical shapes.

Referring to FIG. 9, the cross section of the inlet cover 400 may have a substantially trapezoidal shape, and the inlet cover may be disposed on a first side of the outer surface of the cover plate 200. The inlet cover 400 may include a cover engaging portion 410 and a flange engaging portion 420. The cover engaging portion 410 may be mounted at a first side of the cover plate 200, and may be inclined corresponding to the inlet portion 220 of the cover plate 200. The inlet cover 400 may be engaged with the cover plate 200 through the cover engaging portion 410.

Referring to FIG. 10, at least one engaging aperture 411 may be formed in the cover engaging portion 410 to correspond to the position protrusion 213 formed in the inlet portion 210 of the cover plate 200. When the inlet cover 400 is engaged with the inlet portion 210 of the cover plate 200, the position of the inlet cover 400 may be guided by the position protrusion 213 and the engaging aperture 411.

Referring to FIG. 11, the engaging aperture 411 of the inlet cover 400 may be inserted into the position protrusion 213 of the cover plate 200, and then the inlet cover 400 and the cover plate 200 may be coupled by welding. An inlet flange 600 may be mounted at the flange engaging portion 420. A pipe aperture 421 for engaging the EGR line 51 may be formed in the flange engaging portion 420. The outlet cover 500 may include a cover engaging portion 510 and a flange engaging portion 520. The cover engaging portion 510 may be mounted at a second side of the cover plate 200, and may be inclined corresponding to the outlet portion 220 of the cover plate 200. The outlet cover 500 may be engaged with the cover plate 200 through the cover engaging portion 510.

Referring to FIG. 10, at least one engaging aperture 511 may be formed in the cover engaging portion 510 to correspond to the position protrusion 223 formed in the outlet portion 220 of the cover plate 200. When the outlet cover 500 is engaged with the outlet portion 220 of the cover plate 200, the position of the outlet cover 500 may be guided by the position protrusion 223 and the engaging aperture 511.

Referring to FIG. 11, the engaging aperture 511 of the outlet cover 500 may be inserted into the position protrusion 223 of the cover plate 200, and then the inlet cover 400 and the cover plate 200 may be coupled by welding. An outlet flange 700 may be mounted at the flange engaging portion 520. A pipe aperture 521 for engaging the EGR line 51 may be formed in the flange engaging portion 520.

As described above, since the cover engaging portions 410 and 510 are inclined, the distance between the coolant flowing in the coolant passage and the inlet cover 400 and the outlet cover 500 may be decreased. As a result, the inlet cover 400 and the outlet cover 500 may be cooled more easily, and durability may be improved. As described above, the tube 110, the fixation member 150, the cover plate 200, the baffle 300, the inlet cover 400, the outlet cover 500, the inlet flange 600 and the outlet flange 700 may be made of aluminum material.

Since the above-described parts are made of aluminum having a thermal conductivity higher than that of the conventional material, the cooling efficiency of the exhaust gas circulating inside the tube 110 is increased, and thus the fuel efficiency of the vehicle may be improved. Further, since the cost of the aluminum is cheaper than conventional materials, it may be possible to reduce material cost. Further, since the aluminum lighter than conventional materials, the overall weight of the EGR cooler 55 may be reduced.

Hereinafter, an operation of the EGR cooler 55 according to an exemplary embodiment of the present invention will be described in detail. The exhaust gas flowing in the EGR line 51 may flow into the inlet portion 210 of the cover plate 200 through the inlet flange 600 and the inlet cover 400. The exhaust gas flowing in the inlet portion 210 of the cover plate 200 may be distributed to the plurality of tubes 110, and may flow into the plurality of tubes 110. Simultaneously, some coolant may flow into the mounting space 23 through the coolant inlet 25 from a water jacket (not shown).

The exhaust gas flowing through the plurality of tubes 110 may be heat-exchanged with the coolant flowing through the coolant passage, and the temperature of the exhaust gas may be decreased. The exhaust gas, having a decreased temperature due to the heat exchange with the coolant, may be exhausted from the plurality of tubes 110 to the EGR line 51 via the outlet portion 230 of the cover plate 200, the outlet cover 500 and the outlet flange 700.

DESCRIPTION OF SYMBOLS

10: engine
13: intake manifold
15: throttle valve
17: exhaust manifold
20: cylinder block
21: combustion chamber
23: mounting space
25: coolant inlet
27: coolant outlet
30: intake line
31: air cleaner
32: compressor
33: turbocharger
34: turbine
35: intercooler
40: exhaust line
41: catalytic converter
50: EGR device
51: EGR line
53: EGR valve
55: EGR cooler
100: tube assembly
110: tube
111: inlet inclination portion
113: inlet curved surface portion
115: cooling portion
117: cooling fin
118: guide protrusion
119: outlet curved surface portion
121: outlet inclination portion
123: gap protrusion
130: first tube partition
131, 141: contacting surface
140: second tube partition
150: fixation member
200: cover plate
210: inlet portion
211: inflow aperture
213, 223: position protrusion
220: outlet portion
221: outflow aperture
230: mounting portion
231: center portion
233, 235: inclination portion
240: flange portion
241: bending portion
243: engage aperture
300: baffle
310: inserting portion
320: welding portion
330: passage portion
400: inlet cover
410: cover engaging portion
411: engaging aperture
420: flange engaging portion
500: outlet cover
510: cover engaging portion
511: engaging aperture
520: flange engaging portion
600: inlet flange
700: outlet flange While this invention has been described in connection with what is presently considered to be exemplary embodiments, it is to be understood that the invention is not limited to the disclosed exemplary embodiments. On the contrary, it is intended to cover various modifications and equivalent arrangements included within the spirit and scope of the appended claims.

What is claimed is:

1. An exhaust gas recirculation (EGR) cooler comprising:
a tube assembly formed by stacking a plurality of tubes in which exhaust gas flows;
a cover plate having a mounting portion formed concavely to mount the tube assembly thereon;
a baffle mounted at the tube assembly and configured to adjust flow of coolant inflow from a cylinder block;
an inlet cover installed on a first side of an outer surface of the cover plate to supply the exhaust gas to each tube;
an outlet cover installed on a second side of outer surface of the cover plate to exhaust the exhaust gas from each tube;
wherein at least one coolant passage in which the coolant flows is formed between the plurality of tubes;
a first inclination portion of the cover plate formed to be inclined at a first side of the mounting portion; and
a second inclination portion of the cover plate formed to be inclined at a second side of the mounting portion,
wherein each tube includes:
a cooling portion forming an exhaust gas passage;
an inlet curved surface portion formed to be rounded from a first end of the cooling portion toward the cover plate;
an outlet curved surface portion formed to be rounded from a second end of the cooling portion toward the cover plate;
an inlet inclination portion formed at an end of the inlet curved surface portion to be opened to allow the exhaust gas to flow into the exhaust gas passage of the cooling portion; and
an outlet inclination portion formed at an end of the outlet curved surface portion to be opened to exhaust the exhaust gas from the exhaust gas passage of the cooling portion,
wherein the first inclination portion is inclined toward the tube assembly from a first side of an inner surface of the cover plate, and the second inclination portion is inclined toward the tube assembly from a second side of the inner surface of the cover plate, wherein the first inclination portion and the second inclination portion are formed between a plurality of inflow apertures, and wherein the tube assembly is engaged with the cover plate, the inlet inclination portion of each tube is inserted into each inflow aperture, and the outlet inclination portion of each tube is inserted into each outflow aperture.

2. The EGR cooler of claim 1, wherein the tube assembly includes a fixation member for fixing the plurality of tubes.

3. The EGR cooler of claim 1, wherein each tube includes:

at least one cooling fin for cooling the exhaust gas; and a guide protrusion for guiding a position of the cooling fin.

4. The EGR cooler of claim 1, further comprising:

at least one gap protrusion is formed in each tube for adjusting a distance between neighboring tubes of the plurality of tubes.

5. The EGR cooler of claim 1, further comprising:

a bending portion formed at an edge of a flange portion formed on an outer periphery of the cover plate.

6. The EGR cooler of claim 1, further comprising:

an inlet cover engaging portion formed in the inlet cover corresponding to the first inclination portion, and an outlet cover engaging portion formed in the outlet cover corresponding to the second inclination portion.

7. The EGR cooler of claim 1, further comprising:

a position protrusion formed in the cover plate; and an engaging aperture formed in the inlet cover and the outlet cover corresponding to the position protrusion, wherein the inlet cover and the outlet cover are guided by inserting the position protrusion into the engaging aperture.

8. An engine system, comprising:

an engine including a cylinder block in which a mounting space is formed, a coolant inlet through which coolant flows into the mounting space, and a coolant outlet through which the coolant is exhausted from the mounting space;

an intake line in which external air supplied to the engine flows;

an exhaust line in which exhaust gas generated in the engine flows;

an exhaust gas recirculation (EGR) line branched off from the exhaust line and merged into the intake line; and an EGR cooler configured to cool the exhaust gas flowing through the EGR line;

wherein the EGR cooler includes:

a tube assembly formed by stacking a plurality of tubes in which exhaust gas flows, wherein the tube assembly is mounted in the mounting space;

a cover plate including a mounting portion formed concavely to mount the tube assembly thereon, and covering the mounting space;

a baffle mounted at the tube assembly and configured to adjust flow of coolant inflow from the coolant inlet;

an inlet cover installed on a first side of the cover plate to supply the exhaust gas to the tube;

an outlet cover installed on a second side of the cover plate to exhaust the exhaust gas from the tube;

wherein coolant passages in which the coolant flows are formed between the tube assembly and the mounting space, between each of the plurality of tubes and between the tube assembly and the cover plate;

a first inclination portion of the cover plate formed to be inclined at a first side of the mounting portion; and a second inclination portion of the cover plate formed to be inclined at a second side of the mounting portion, wherein each tube includes:

a cooling portion forming an exhaust gas passage;

an inlet curved surface portion formed to be rounded from a first end of the cooling portion toward the cover plate;

an outlet curved surface portion formed to be rounded from a second end of the cooling portion toward the cover plate;

an inlet inclination portion formed at an end of the inlet curved surface portion to be opened to allow the exhaust gas to flow into the exhaust gas passage of the cooling portion; and an outlet inclination portion formed at an end of the outlet curved surface portion to be opened to exhaust the exhaust gas from the exhaust gas passage of the cooling portion, wherein the first inclination portion is inclined toward the tube assembly from a first side of an inner surface of the cover plate, and the second inclination portion is inclined toward the tube assembly from a second side of the inner surface of the cover plate, wherein the first inclination portion and the second inclination portion are formed between a plurality of inflow apertures, and wherein the tube assembly is engaged with the cover plate, the inlet inclination portion of each tube is inserted into each inflow aperture, and the outlet inclination portion of each tube is inserted into each outflow aperture.

9. The engine system of claim 8, wherein the tube assembly includes a fixation member for fixing the plurality of tubes.

10. The engine system of claim 8, wherein each tube includes:

at least one cooling fin for cooling the exhaust gas; and a guide protrusion for guiding a position of the cooling fin.

11. The engine system of claim 8, further comprising:

at least one gap protrusion formed in each tube for adjusting a distance between neighboring tubes of the plurality of tubes.

12. The engine system of claim 8, further comprising:

a bending portion formed at an edge of a flange portion formed on an outer periphery of the cover plate.

13. The engine system of claim 8, further comprising:

an inlet cover engaging portion formed in the inlet cover corresponding to the first inclination portion; and an outlet cover engaging portion formed in the outlet cover corresponding to the second inclination portion.

14. The engine system of claim 8, further comprising:

a position protrusion formed in the cover plate; and an engaging aperture formed in the inlet cover and the outlet cover corresponding to the position protrusion, wherein the inlet cover and the outlet cover are guided by inserting the position protrusion into the engaging aperture.

* * * * *